United States Patent [19]

Harryman

[11] Patent Number: 4,496,380

[45] Date of Patent: Jan. 29, 1985

[54] CRYOGENIC GAS PLANT

[75] Inventor: John M. Harryman, New Orleans, La.

[73] Assignee: Shell Oil Company, Houston, Tex.

[21] Appl. No.: 511,448

[22] Filed: Jul. 7, 1983

Related U.S. Application Data

[62] Division of Ser. No. 324,361, Nov. 24, 1981, abandoned.

[51] Int. Cl.[3] ..... F25J 3/02

[52] U.S. Cl. ..... 62/24; 62/31; 62/34; 62/42

[58] Field of Search ..... 62/23, 24, 31, 32, 34, 62/42, 27, 28, 29, 30, 41, 42

[56] References Cited

U.S. PATENT DOCUMENTS

| | | | |
|---|---|---|---|
| 2,471,602 | 5/1949 | Arnold | 62/31 |
| 2,880,592 | 4/1959 | Davison et al. | 62/25 |
| 3,292,380 | 12/1966 | Bucklin | 62/20 |
| 3,675,435 | 7/1972 | Jackson et al. | 62/23 |

OTHER PUBLICATIONS

"Evolution in Design", by R. L. McKee, presented at 56th Annual GPA Convention, Dallas, Texas, Mar. 21-23, 1977.

"Flexibility Can Boost Profits in Cyogenic Gas-Processing Plants", article by Larry E. Evans, Randall Corp., Houston, Texas, published in Oil & Gas Journal, Jul. 14, 1980.

*Primary Examiner*—Frank Sever

[57] ABSTRACT

A process for separating substantially all of the $C_3$ and heavier components and a major portion of the $C_2$ component from a natural gas stream using a cryogenic process. The process uses a rectifying column in combination with a fractionating column to separate the $C_2$ and heavier components with the reflux for the rectifying column being supplied by compressing a small portion of the overheads and condensing it via heat exchange with the overheads stream.

8 Claims, 1 Drawing Figure

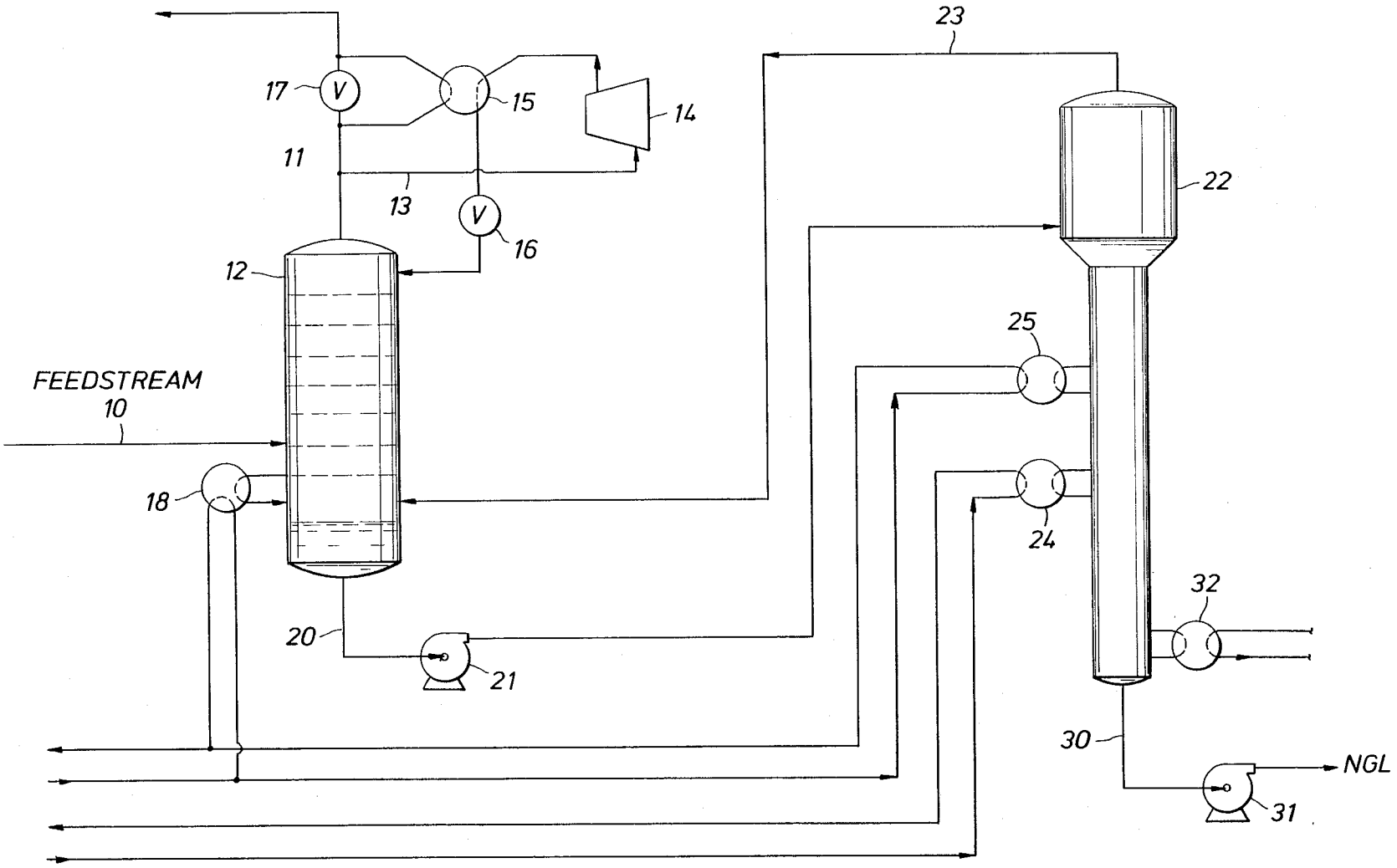
NGL
31
32
22
30
25
24
23
14
15
16
21
13
17
11
20
12
18
FEEDSTREAM
10

CRYOGENIC GAS PLANT

This is a division of application Ser. No. 324,361, filed Nov. 24, 1981, abandoned.

BACKGROUND OF THE INVENTION

The present invention relates to cryogenic gas plants and particularly to gas plants which are designed to separate natural gas liquids (NGL), which contain ethane and higher boiling hydrocarbons from a natural gas stream. The evolution of cryogenic gas plants is reviewed in a paper presented at the 1977 Gas Processing Association Convention entitled "Evolution in Design" by R. L. McKee. This paper describes the use of turbo-expanders to increase the thermodynamic efficiency of the gas plant and thus improve its overall economics. A similar type of cryogenic system for recovering ethane and higher boiling hydrocarbons from a natural gas stream is described in U.S. Pat. No. 3,292,380. A more recent description of cryogenic gas processing plants appears in the July 14, 1980 edition of the "Oil and Gas Journal" at page 76 et. seq. All of these references describe the use of a turbo-expander for supplying the feedstock to a demethanizing column where the methane is separated from the ethane and the higher boiling hydrocarbons.

While these systems have been satisfactory, they do not recover all the ethane and higher boiling point liquids. The ethane and higher boiling point liquids are used as chemical feedstocks which have more value in today's markets as chemical feedstocks than as natural gas. The lack of complete recovery of the ethane partially is due to the relative volatility of methane to ethane and to the fact that a considerable amount of the ethane is contained as a vapor in the methane when it enters the demethanizing column. The portion of the ethane contained as vapor remains in the gas phase and is discharged from the top of the column as pipeline gas.

A further problem arises when attempts are made to operate plants near their capacity or beyond. When operating plants at or above their capacity, flooding of the demethanizing column with liquid occurs. When this occurs, additional ethane and higher boiling point liquids are lost to the natural gas stream instead of being condensed and removed as liquid from the bottom of the column.

SUMMARY OF THE INVENTION

The present invention solves the above problems by placing a rectifying column ahead of the demethanizing stripper column. The rectifying column is provided with reflux while the liquefied bottom stream from the rectifying column is used as a feed for the demethanizing column. The combination of the rectifying column and the demethanizing column can provide essentially 100% recovery of the ethane and higher boiling point liquids from the natural gas stream. The reflux of the rctifying column uses a small portion of the overhead stream from the rectifying column, about 10% to 17%. The reflux stream is produced by a compressor and a condenser which is cooled by the overhead stream from the rectifying column. The use of a liquid reflux stream increases recovery of NGL, the ethane and higher boiling point liquids, while the use of the demethanizing column insures that sufficient methane will be removed from the NGL product. It is to be noted that the rectifying column also can be placed on top of the demethanizing stripper column, both being one common vessel, in order to reduce equipment costs and complexity, including elimination of the need to pump liquid from the bottom of the rectifying column to the top of the demethanizing column.

BRIEF DESCRIPTION OF THE DRAWINGS

The present invention will be more easily understood from the following detailed description of a preferred embodiment when taken in conjunction with the attached drawing showing schematically a gas processing system constructed according to the present invention.

DESCRIPTION OF A PREFERRED EMBODIMENT

Referring to the attached drawing, there is shown a rectifying column 12 that has been added ahead of the demethanizing stripper column 22. The demethanizing column is part of the original gas processing plant and was supplied with a partially liquefied feedstream 10 from a turbo-expander not shown in the drawings. The plant, as originally designed, will recover approximately 76% of the ethane while the present invention will result in a recovery of approximately 93% of the ethane and essentially all of the higher boiling liquids.

While the feedstream 10 is supplied by a turbo-expander in the existing plant other systems could be used to supply the cold vapor liquid feedstream. For example, refrigeration systems could be used to supply the feedstream. The feedstream should have a temperature in the range of −100° F. to −175° F. and a pressure in the range of 250 psi to 450 psi. In the existing plant the feedstream from the turbo-expander has a pressure of 385 psi and a temperature of −135° F.

Rectifying column 12 is supplied with the feedstream 10, formerly supplied to the demethanizing column 22, having a temperature of approximately minus 137° F. and comprising essentially methane gas and higher boiling point liquid hydrocarbons. The ethane and higher boiling point liquids are stripped from the feedstream and removed from the bottom of the rectifying column while the methane is withdrawn as an overhead stream 11. A small portion of the overhead stream of the column 12 is taken off as a reflux stream 13 and compressed by compressor 14. As explained above, the reflux should comprise a small portion of the total flow, approximately 10% to 17%, of the overhead stream. The compressed reflux stream is passed through a condenser 15 where it is condensed by the overhead stream 11 with the flow of the overhead stream through the condenser being controlled by a bypass valve 17. A valve 16 controls the condensing pressure and the flow of reflux to the rectifying column 12. The liquid reflux supplied to the rectifying column effects recovery of most of the ethane and essentially all the higher boiling point hydrocarbon from the feedstream 10. The liquid bottom stream 20, including a substantial quantity of methane, is pumped to the demethanizing column 22 by pump 21.

The top stream 23 from the demethanizing column, consisting of methane and a smaller amount of ethane and higher boiling liquids, flows into the bottom of the rectifying column. The rectifying column 12 and the demethanizing column 22 are reboiled by warmer portions of the gas stream upstream of the turboexpander, not shown in the drawing.

NGL product is withdrawn from the bottom of demethanizing column 22 through a line 30 and supplied by pump 31 as a chemical feedstock to other processing units not shown. The bottom reboiler 32 and side reboilers 24 and 25 ensure that sufficient methane is removed from the NGL product.

From the above description, it is seen that only a small portion of the overhead stream of the rectifying column is used as reflux. Further, a compressor can be used to compress this fluid to higher pressure which permits its condensation to a liquid using the overhead stream from the column as the cooling medium. Thus, a liquid reflux is obtained with minimum expenditure of energy in contrast to the use of turboexpanders in prior systems. The use of a liquid reflux in the rectifying column ensures that more than 90% of the ethane and essentially 100% of the higher boiling point liquids are removed from the feedstream 10. By removing some of the methane from the liquid in the rectifying column, the load on the demethanizing column 22 is reduced with the net result that the throughput of the plant can be increased if one so desires.

What is claimed is:

1. A process for separating ethane and heavier components from a natural gas stream utilizing a cryogenic plant having a cold feedstream, said process comprising:

retrofitting said process to include a rectifier section upstream of a demethanizer;

introducing the cold feedstream into the rectifier section to recover ethane from the feedstream stream and withdrawing the methane through the overhead stream;

passing 1 to 17 percent of the overhead stream back to the top of said rectifier as a reflux stream, the pressure of said reflux stream being increased above the pressure of said overhead stream and then condensed;

directly introducing the bottoms of said rectifier as the feed to a demethanizer column;

directly returning the top stream of said demethanizer as a bottom feed to said rectifier;

withdrawing substantially all of said ethane and heavier components from the bottom of said demethanizer.

2. The process of claim 1 wherein the condenser is cooled by the top stream of said rectifier.

3. The process of claim 1 wherein the rectifier section and demethanizer column are separate vessels.

4. The process of claim 1 wherein the rectifier section and demethanizer are part of a common vessel.

5. The process of claim 1 and in addition reboiling at least a portion of liquid in the demethanizing column.

6. The process of claim 5 wherein at least two side reboilers and a bottom reboiler are used.

7. The process of claim 1 wherein a portion of the liquid in the rectifier section is reboiled.

8. The process of claim 1 wherein the feedstream has a temperature of between −100° F. and −175° F. and a pressure of between 250 and 450 pounds per square inch.

* * * * *